United States Patent [19]

Foy et al.

[11] Patent Number: 4,917,255

[45] Date of Patent: Apr. 17, 1990

[54] COLLAPSIBLE CONTAINER

[75] Inventors: Dennis M. Foy, Birmingham; Charles Baughman, Southfield, both of Mich.

[73] Assignee: J.I.T. Corporation, Southfield, Mich.

[21] Appl. No.: 315,478

[22] Filed: Feb. 24, 1989

[51] Int. Cl.[4] ..... B65D 88/52

[52] U.S. Cl. ..... 220/4 F; 206/503; 206/600; 220/7; 220/457

[58] Field of Search ..... 206/503, 386, 600; 220/1.5, 4 F, 6, 7, 254, 457

[56] References Cited

U.S. PATENT DOCUMENTS

| | | | |
|---|---|---|---|
| 3,853,238 | 12/1974 | Luisada et al. | 220/4 F |
| 3,968,895 | 7/1976 | Barnes, Jr. et al. | 206/600 |
| 4,005,795 | 2/1977 | Mikkelsen et al. | 220/7 |
| 4,186,841 | 2/1980 | Buckley et al. | 220/6 |
| 4,380,300 | 4/1983 | Mountz et al. | 206/598 |
| 4,693,386 | 9/1987 | Hughes et al. | 220/7 |
| 4,735,330 | 4/1988 | Hoss | 220/7 |

FOREIGN PATENT DOCUMENTS

| | | | |
|---|---|---|---|
| 0211116 | 2/1987 | European Pat. Off. | 206/600 |

*Primary Examiner*—Jimmy G. Foster

*Attorney, Agent, or Firm*—Reising, Ethington, Barnard, Perry & Milton

[57] ABSTRACT

A collapsible container assembly (10) including a base (12) having a plurality of sides (14), a pair of side walls (16,18) and a pair of end walls (20,22) with each wall adapted to be extended vertically upward from a side (14) of the base (12) to define an interior portion (24) of the container (10), interlocking flanges (66,78) on adjacent side and end walls (16,18,20,22) for providing interlocking engagement when the walls are in the upright position and preventing relative movement therebetween, a wall hinge (26) interconnecting each of the side and end walls (16,18,20,22) to the base (12) and moveably supporting the walls as the walls are moved between a collapsed position to an upright position with the walls (16,18,20,22) specifically configured to nest efficiently while in the collapsed position and being able to support a load as other containers (10) are stackedd thereon, wall latches (90) for releasably latching adjacent side and end walls (16,18,20,22) together when the side and end walls are in the upright position, the wall latches being accessible from the interior of the container for releasing the latches (90) to collapse the walls (16,18,20,22).

16 Claims, 10 Drawing Sheets

10
12
14
16
20
22
26
36
38
40
42
44
46
56
58
60
62
64
68
90
96
98
100
114
116
117
118
120
122
124
126
128
130
132
136
138

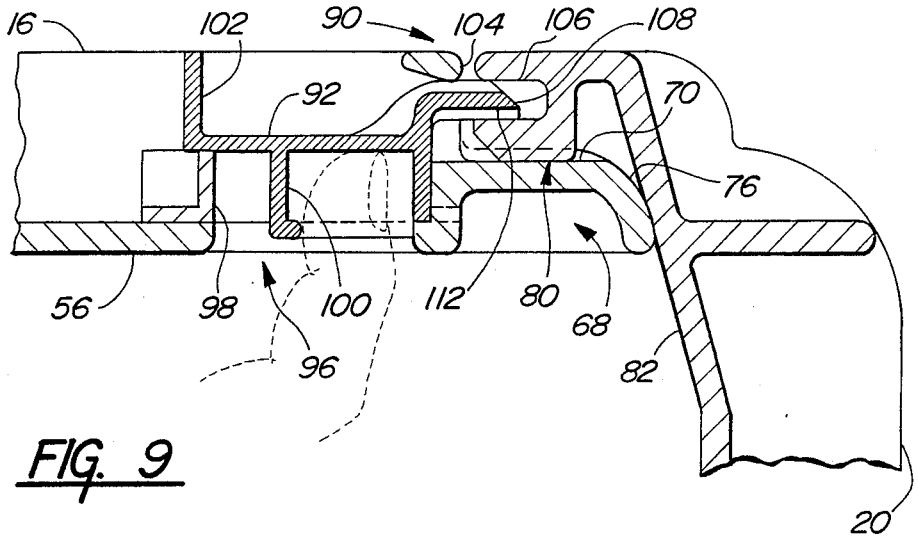
FIG. 9
FIG. 10
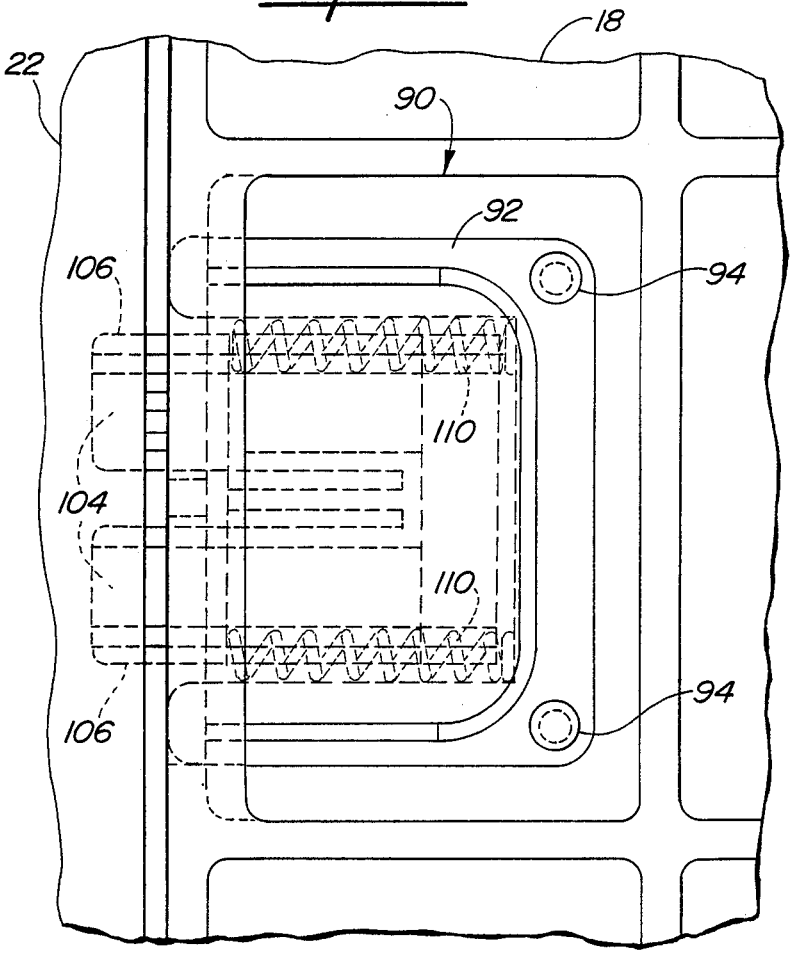

COLLAPSIBLE CONTAINER

BACKGROUND OF THE INVENTION

(1) TECHNICAL FIELD

The invention relates to containers of the type used for packaging, shipping and inventoring goods in bulk. More specifically the invention relates to containers which are collapsible after they have been emptied and stackable in either their collapsed or upright positions in order to reduce the spaced required for them to be shipped or stored.

(2) DESCRIPTION OF THE PRIOR ART

In recent history, various economic factors have motivated manufactures of goods to keep inventories of raw materials as well as finished goods to a minimum thereby avoiding the waste of expensive floor space and lowering the cost of doing business by reducing the amount of inventory sitting in the plant at any given time. As a result of this motivation, containers for shipping, storing and inventoring raw materials as well as finished goods have been developed which are capable of being stacked one upon another in either the upright or collapsed positions for shipment or storage.

Collapsible container assemblies for use in packaging shipping and inventoring goods in bulk are well known in the art. For example, U.S. Pat. No. 4,320,845 issued to Waller on Mar. 23, 1982; U.S. Pat. No. 4,062,467 issued to Friedrich on Dec. 13, 1977; U.S. Pat. No. 4,624,381 issued to Friedrich on Nov. 25, 1986; German Patent No. DE 3500427 Al issued to Friedrich; U.S. Pat. No. 4,591,065 issued to Foy on May 27, 1986; U.S. Ser. No. 022,996 filed Mar. 6, 1987 on behalf of Foy; U.S. Ser. No. 288,634 which is a divisional application of Ser. No. 022,996 filed on behalf of Foy; and U.S. Pat. No. 4,674,647 issued to Gyenge et al on June 23, 1987 all disclose collapsible containers including molded plastic bases having four side walls extending vertically upward from each side of the base. Further, all of these prior art patents disclosed means acting between the adjacent side and end walls for preventing relative movement therebetween. However, problems do exist in the prior art while the container side walls are rapidly moved from the collapsed to the upright position with respect to the interlocking of the flanges on the adjacent side and end walls. Many times, they do not mate properly requiring an operator to specifically and precisely position the adjacent side and end walls such that the interlocking flanges engage. Further, once nested, the interlocking flanges of the prior art still allow some relative movement of the adjacent side walls especially when the containers are heavily loaded.

Presently, collapsible containers of the subject invention are often employed directly adjacent the assembly process. More specifically, many times erected upright containers are disposed in close proximity to each other on a conveyor means adjacent the end of an assembly line for receiving newly manufactured goods or at a point along the assembly process and containing inventory or work in process. Further, collapsible containers are often disposed in close proximity to each other during shipping and at other times. However, a problem arises in moving the side walls from an upright position to a collapsed position when a container becomes empty but is still in close proximity or adjacent another container. This is because, typically in the prior art, latches are disposed on the side walls and accessible only from the outside of the container for releasing the latches to allow the walls to collapse. When the containers are closely juxtaposed with respect to one another, it is very difficult to disengage the latches.

Other problems exist in the prior art with respect to these side walls nesting efficiently upon one another when the container is in the collapsed position such that the container may support other containers stacked thereon without failure due to the resulting loads. Further, the bases of the collapsible containers in the prior art have been known to fail due to the ever increasing loads as the container are employed to ship and store relatively heavy goods.

The subject invention overcomes all of these deficiencies in the prior art in a very durable, relatively light weight and extremely versatile collapsible container.

SUMMARY OF THE INVENTION AND ADVANTAGES

The subject invention is directed toward a collapsible container assembly including a base having a plurality of sides, a pair of side walls and a pair of end walls with each of the walls adapted to be extended vertically upward from a side of the base to define an interior portion of the container. The assembly also includes wall hinge means interconnecting each of the side and end walls to the base and moveably supporting the walls as the walls are moved between a collapsed position to an upright position. The base includes a rigid portion forming the bottom of the container with the rigid portion being made of one material and reinforced with another material for strengthening the base of the container. The assembly also includes hinge means interconnecting each of the side and end walls to the base and movably supporting the walls as they are moved between a collapsed position to an upright position. The hinge means are disposed and each wall is specifically configured to securely and efficiently nest when the container is in the collapsed position. The assembly further includes wall latching means for releasably latching adjacent side and end walls together when the side and end walls are in the upright position. The wall latching means includes a latch member movable between latched and unlatched positions and also includes a means disposed on the interior of the container for moving the latch member to the unlatched position. Finally, the subject invention includes a locking means on adjacent side an end walls for providing interlocking engagement therebetween when the walls are in the upright position and are specifically adapted for allowing the adjacent side and walls to be rapidly removed from the collapsed to the upright position and efficiently nesting so as to preclude relative movement therebetween.

Accordingly, the subject invention overcomes the problems of the prior art by including a collapsible container assembly with a very strong base and side walls which are specifically constructed for efficient nesting when the walls are in a collapsed condition and which may support large loads when stacked. The container of the subject invention further overcomes the problems in the prior art by including wall latching means which are specifically adapted to release the latches from the inside of the container allowing the container to be collapsed even when it is juxtaposed in close proximity to another containers. Finally, the collapsible container of the subject invention includes locking means on adjacent side and end walls which preclude relative movement between adjacent side and end walls in a manner superior to the prior art.

BRIEF DESCRIPTION OF THE DRAWINGS

Other advantages of the present invention will be readily appreciated as the same becomes better understood by reference to the following detailed description when considered in connection with the accompanying drawings wherein:

FIG. 9 is an enlarged elevational view of the wall latching means in the latched position;

FIG. 10 is an enlarged plan view of the wall latching means with adjacent side and end walls latched in the vertical position;

DESCRIPTION OF THE PREFERRED EMBODIMENT

Figure 1:
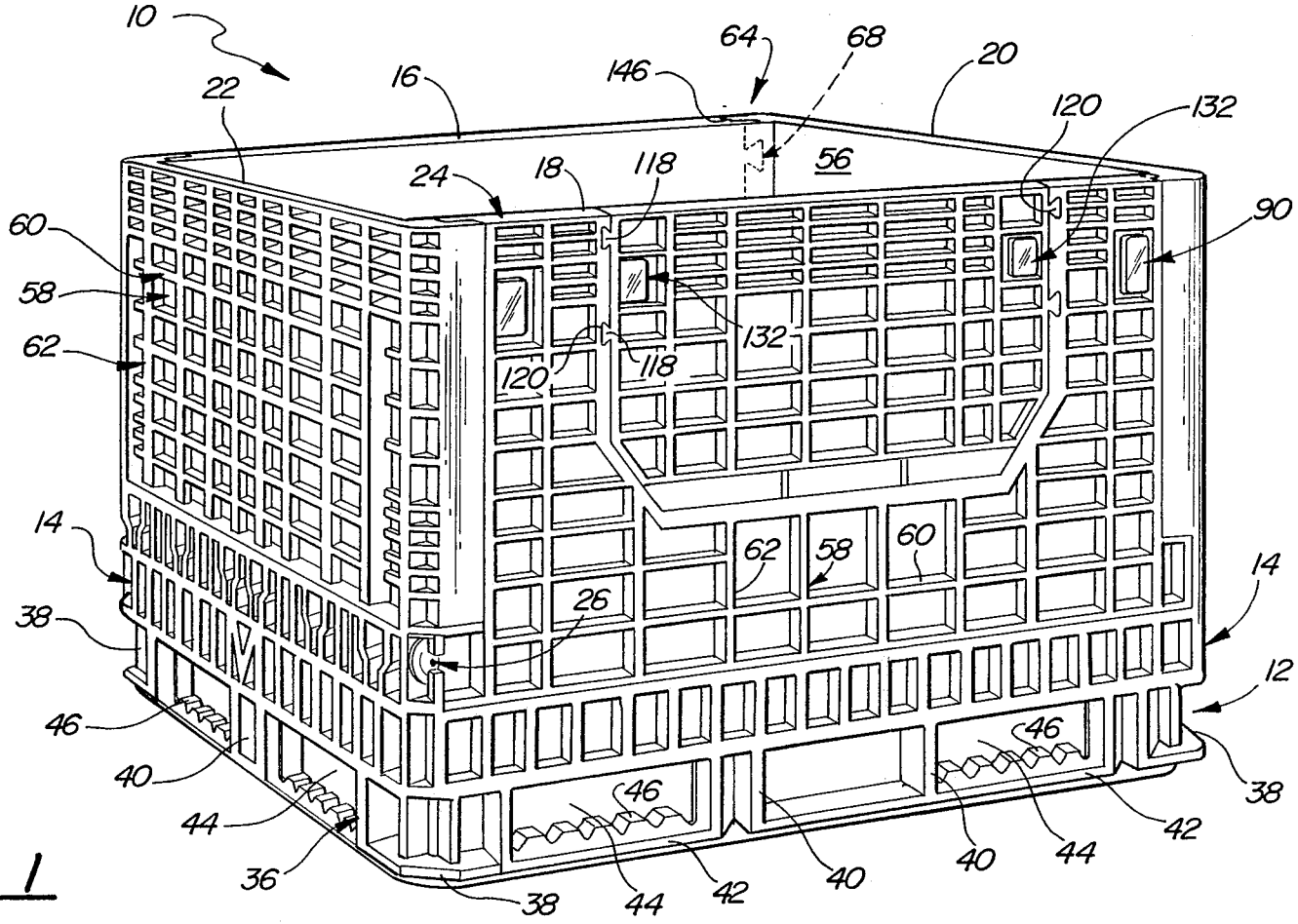
FIG. 1 is a perspective view of the container with the walls in a vertically locked position.
Figure 2:
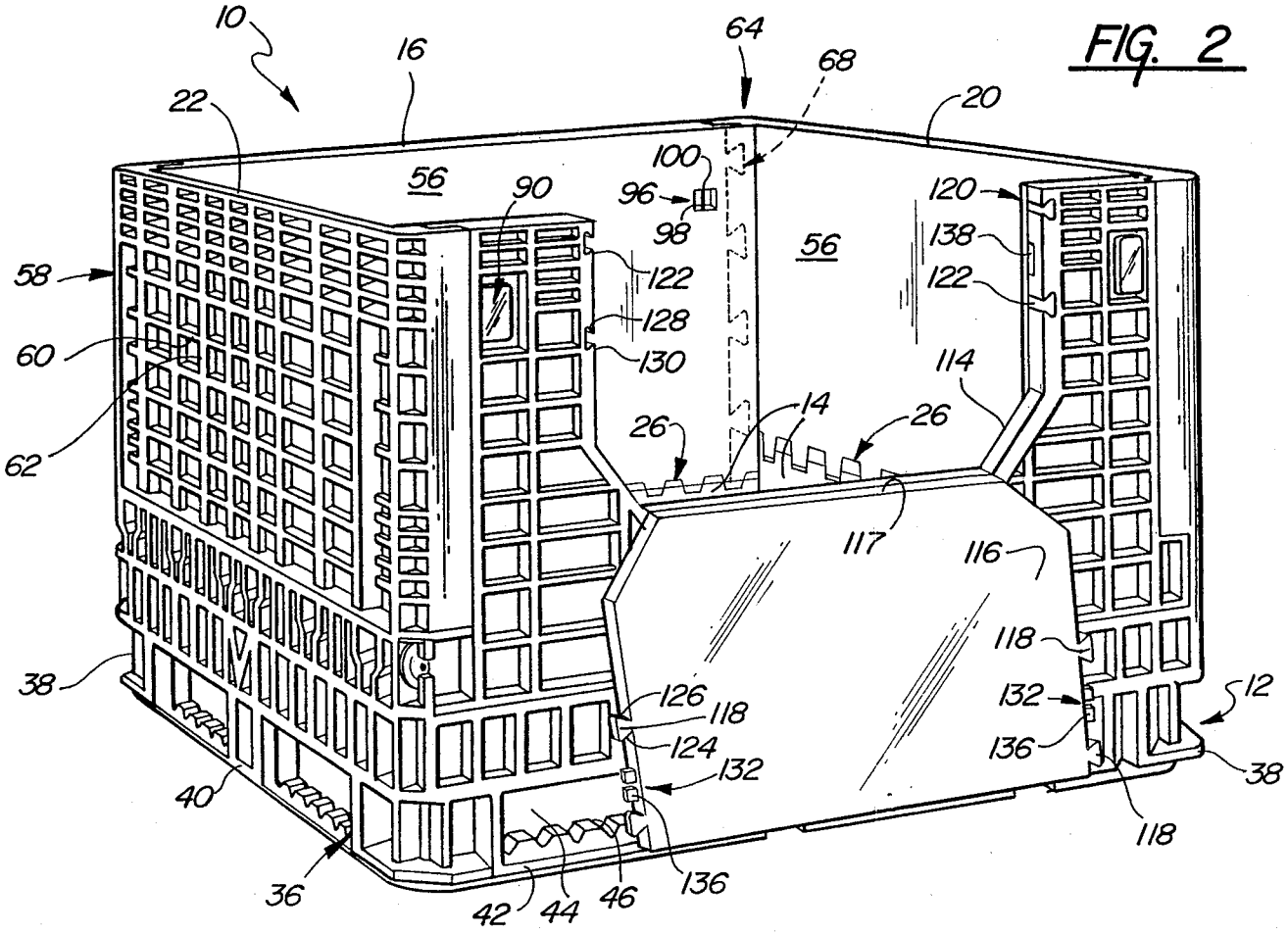
FIG. 2 is perspective view wherein a door in a side wall has been unlocked and folded outward.

A collapsible container assembly of the subject invention is generally indicated at 10 in FIGS. 1 and 2. The container assembly 10 includes a base generally indicated at 12 which has a plurality of sides generally indicated at 14. The assembly further includes a pair of side walls 16 and 18 and a pair of end walls 20 and 22. Each of the walls 16, 18, 20, 22 are adapted to be extended vertically upward from a side 14 of the base 12 to define an interior portion 24 of the container 10. The assembly further includes wall hinge means generally indicated at 26 interconnecting each of the side and end walls 16, 18, 20, 22 to the base 12 and movably supporting the walls 16, 18, 20, 22 as they move between a collapsed position to an upright position.

Figure 3:
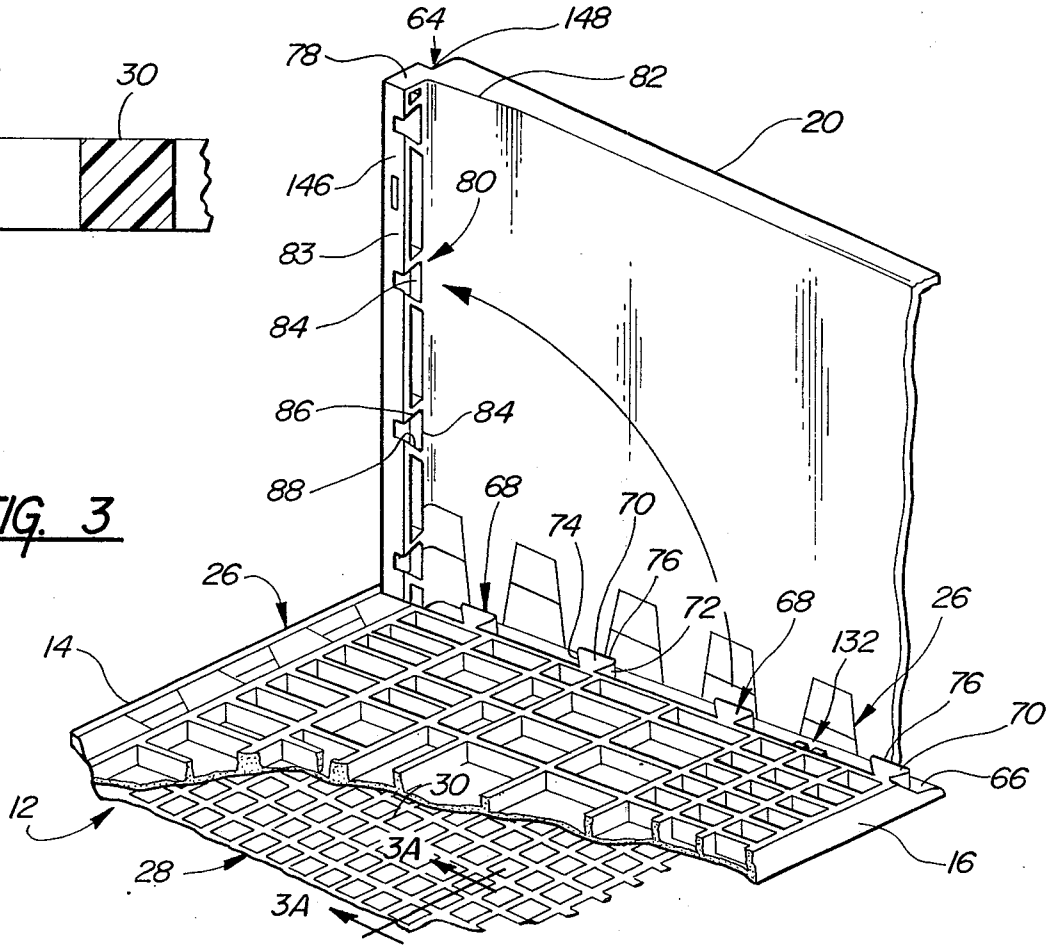
FIG. 3 is a partially broken away perspective view of a corner of the container.
Figure 3A:
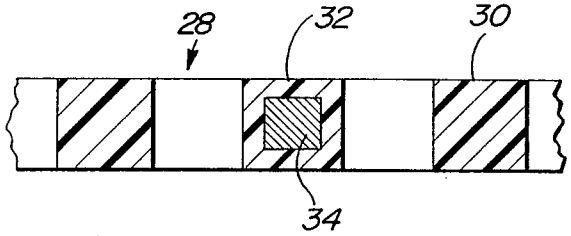
FIG. 3*a* is a cross-sectional view taken substantially along lines 3*a*—3*a* of FIG. 3.

As illustrated in FIGS. 3 and 3A, the base 12 includes a rigid portion generally indicated at 28 forming the bottom of the container 10. In the preferred embodiment of the subject invention, the rigid portion may be made of one material and reinforced with another material for strengthening the base 12 of the container 10. For example, the rigid portion 28 may be made of a structural foam which is reinforced by steel. More specifically, the rigid portion 28 of the subject invention includes a plurality of longitudinal support members 30 disposed parallel and perpendicular with respect to each other to form a grid. The support members 30 are made of structural foam. Further, a plurality of the structural foam support members 30 may include an outer perimeter 32 and an inner member 34 which may be made of steel or any other reinforcing material. Some or all of these structural foam support members 32 may include the reinforcing member 34 for a predetermined length of the support member 32 or they may include the reinforced member 34 for their entire length. In the preferred embodiment of the subject invention, the rigid portion 28 includes a support member 32 disposed centrally on the rigid portion 28 and extending across the rigid portion between base sides 14 bounding the rigid portion. This centrally disposed support member 32 is reinforced by a steel reinforcing member 34 along its entire length between opposing base sides 14. Further, the rigid portion includes two more reinforcing support members 32 disposed on either side of the central support member and in parallel spaced relation to the central support member. In this way, the rigid portion 28 of the base 12 may be strengthened to effectively support the ever increasing load to which containers of the subject invention are being subjected.

Figure 4:
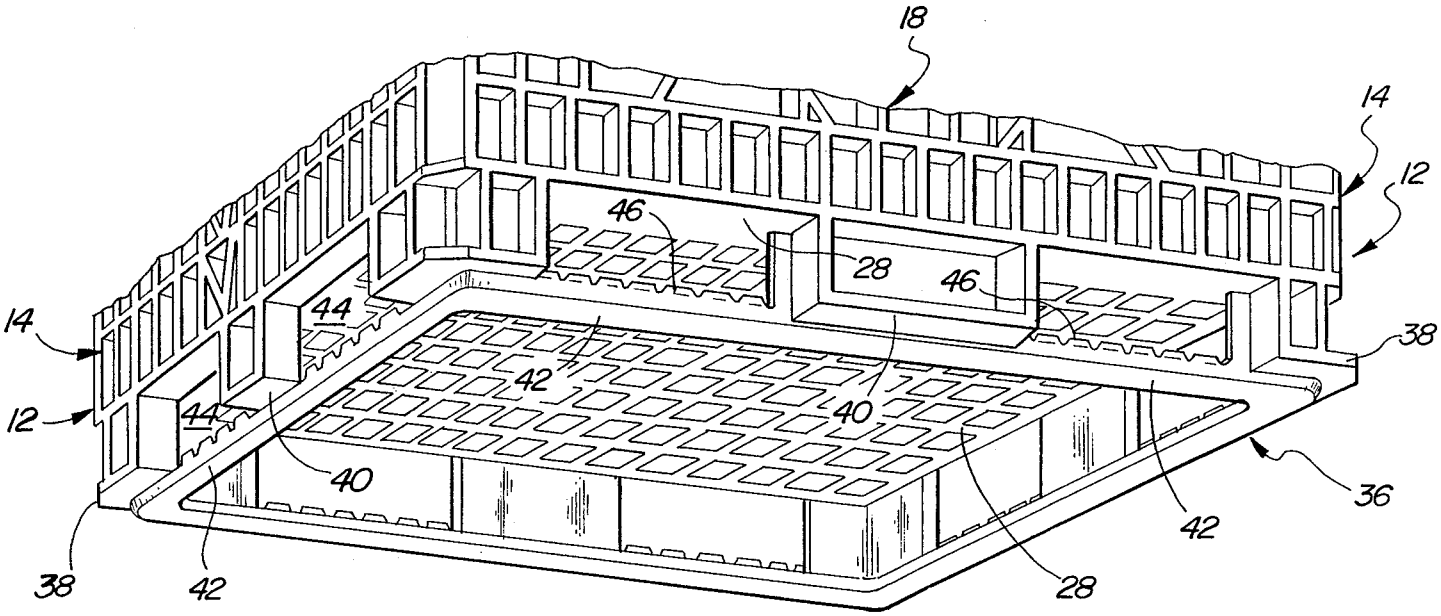
FIG. 4 is a perspective view of the underside of the base of the container.

The base 12 further includes a plurality of container support means generally indicated at 36 depending from the rigid portion 28 about the periphery thereof as illustrated in FIG. 4. The support means 36 includes a corner support member 38 disposed at each of the four corners of the rigid portion 28 and a perimeter support member 40 disposed intermediate the pairs of corner support members 38. The support members 38 and 40 are similar to legs extending downwardly from the rigid portion 28 to space the rigid portion 28 from a support surface. Straps 42 extend between the container support means 36 and define channels 44 between predetermined container support means 36. More specifically, the straps 42 extend between the corner support members 38 and the perimeter support members 40 to define a pair of forked channels 44 on each side of the container for receiving the forks of a fork lift to facilitate the raising and lowering of the container assembly 10. The straps 42 also add to the structural integrity of the container 10 as the container is moved by a fork lift or stacked one upon the other. The straps 42 include irregular shaped surfaces 46 which border the periphery of the channels 44. Said another way, the straps 42 include a corrugated surface 46 which facilitates better heat transfer during the molding process of the structural foam container and thus reduces the occurrence of uneven cooling and "shrink" which commonly plagues the industry.

Figure 5:
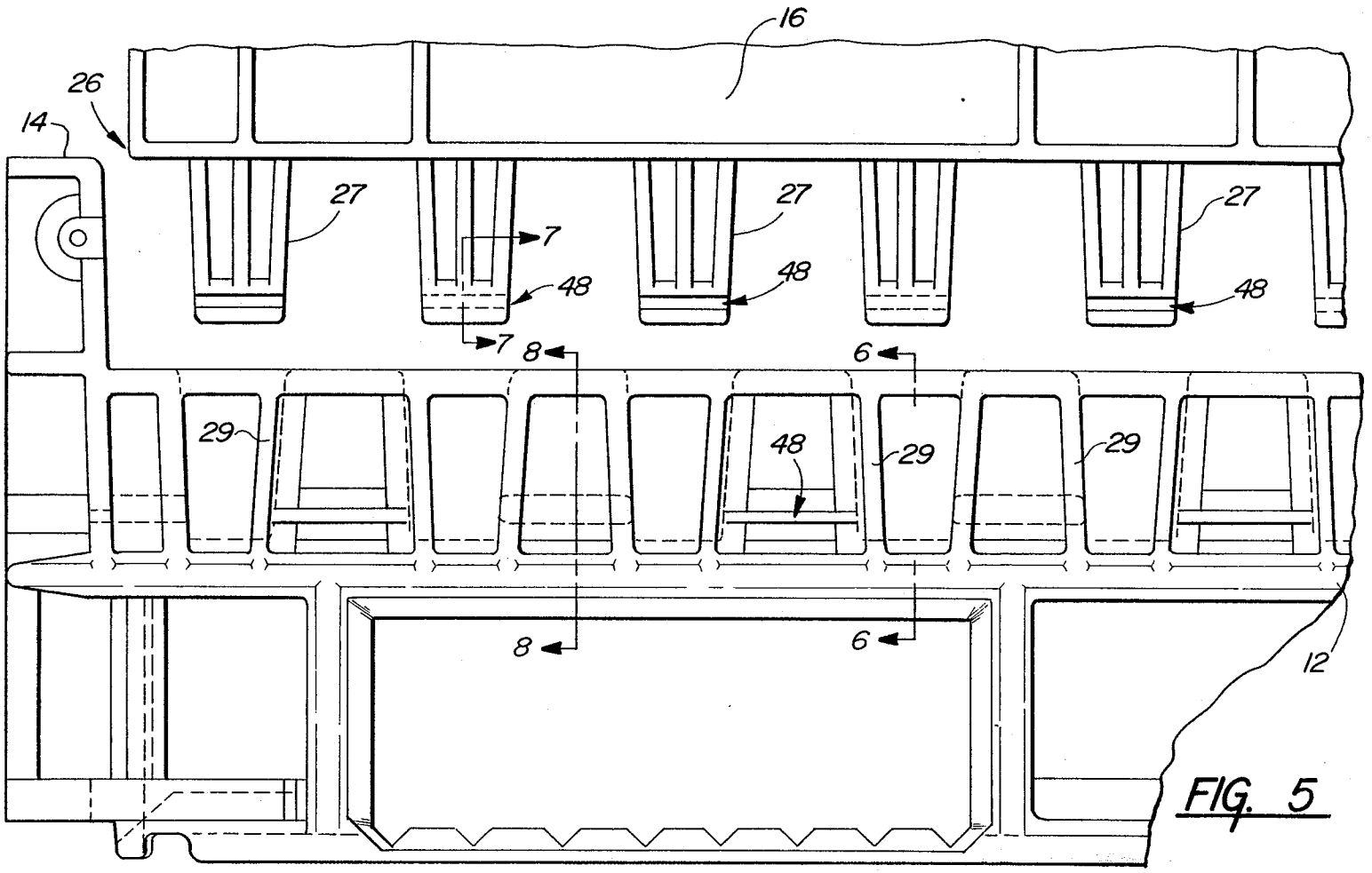
FIG. 5 is an enlarged exploded view of the hinge means of the subject invention.
Figure 6:
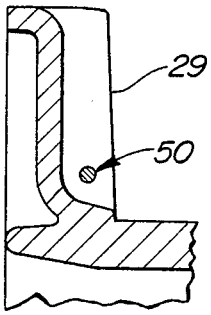
FIG. 6 is a cross-sectional view taken substantially along lines 6—6 of FIG. 5.
Figure 7:
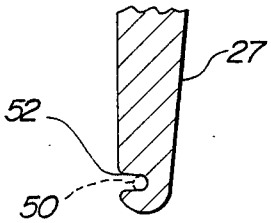
FIG. 7 is a cross-sectional view taken substantially along lines 7—7 of FIG. 5.
Figure 8:
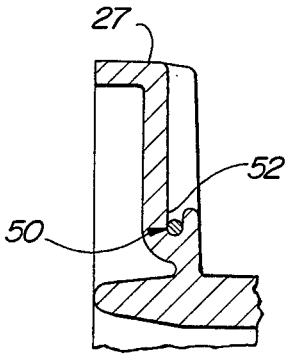
FIG. 8 is a cross-sectional view taken substantially along lines 8—8 of FIG. 5.

The wall hinge means 26 includes a series of tongue and grooves along the bottom edge of the side and end walls 16, 18, 20, 22 and the top edge of the sides 14 of the base 12. More specifically, the tongues 27 of the side and end walls 16, 18, 20, 22 are disposed in the grooves 29 of the sides 14 of the base 12 and vice versa, as shown in FIG. 5. The wall hinge means 26 further includes a series of hinge holes or apertures generally indicated at 48 along the bottom edge of the side and end walls 16, 18, 20, 22 and the top edge of the sides 14 of the base 12 in the tongue and groove arrangement. A rod 50 is disposed in the apertures 48 of the side and end walls 16, 18, 20, 22 and the sides 14 of the base 12 and has a lock washer, or any other suitable means, on each end thereof to secure the tongues 27 in the grooves 29 and to allow pivotal movement of the side and end walls 16, 18, 20, 22 relative to a base 12. FIGS. 6, 7 and 8 illustrate the relationship between the apertures 48 and the rod 50 at various points along the tongue and groove hinge means 26. More specifically, the aperture 48 in the tongues 27 form a trough 52 including an open portion for accepting the rod 50. The open portion in at least one of the troughs 52 is disposed in a direction substantially toward the interior 24 of the container 10, as shown in FIG. 7. Further, the open portion in at least one of the troughs is disposed a direction substantially away from the interior 24 defined by the container 10. Finally, in the hinge means 26 of the preferred embodiment, the tongues 27 are disposed such that the open portions of adjacent tongues 27 are not disposed in the same direction.

The side and end walls 16, 18, 20, 22 have planar interior sheets 56 and ribs generally indicated at 58 on the exterior of the side and end walls and extending outwardly therefrom in spaced relation with respect to each other. The ribs 58 are disposed closer to one another near the tops of the side and end walls 16, 18 and 20 and also near the base to provide greater support to the side and end walls near these areas. The ribs 58 include horizontal ribs 60 and vertical ribs 62. Together, the ribs 58, 60 and 62 form a support matrix for providing greater support to the side and end walls near the top of the wall and near the base 12 of the container assembly 10 and ensures the structural integrity of the assembly under various loading stresses.

Referring now to FIG. 3, the collapsible container assembly 10 also includes locking means generally indicated at 64 disposed on adjacent side and end wall 16, 18, 20, 22 for providing interlocking engagement therebetween when the walls are in the upright position. The locking means 64 includes a flange 66 disposed on the side walls 16 and 18 along a substantial portion of a length thereof. The flange 66 includes at least one locking tab, generally indicated at 68, extending away from the interior 24 of the container 10. The locking tab 68 includes an outermost surface 70 disposed furthest from the interior 24 of the container 10 and first and second locking surfaces 72, 74 extending between the outermost surface 70 and the side wall 66. The tabs 68 further include a contact surface 76 extending between the outermost surface 70 and the side wall flange 66, and between the first and second locking surfaces 72, 74. The contact surface 76 forms an obtuse angle with respect to the outermost surface 70 as shown in FIG. 9.

The locking means 64 further includes a flange 78 disposed on either side of the end walls 20 and 22 and along a substantial portion of the length thereof. The flanges 78 extend perpendicular to the end wall 20, 22 and include means, generally indicated at 80, disposed on the end wall flanges 78 for receiving the locking tab 68 in a snug fashion and thereby locking the walls 16, 18, 20, 22 from relative movement with respect to each other. The end walls 20, 22 further include a guide surface 82 disposed on the end walls 20, 22 directly adjacent the end wall flanges 78. The contact surface 76 on the locking tab 68 is specifically adapted for sliding frictional engagement with the guide surface 82 on the end walls 20, 22 as the side walls 16, 18 are moved from the collapsed position to the upright position. The interaction of these surfaces guide the tab 68 into locking engagement with the means 80 disposed on the end wall flanges 78 for receiving the locking tabs 68 and for preventing relative movement of the walls 16, 18, 20, 22 with respect to each other when in the upright position.

The guide means 82 forms an obtuse angle with the end wall flanges 78 to facilitate the sliding frictional engagement between the contact surface 76 on the locking tab 68 and the guide surface 82 as the side walls 16, 18 are moved from the collapsed position to the upright position as shown in FIG. 9. This feature is an effective means to guide the tab 68 into locking engagement with the means 80 disposed on the end wall flanges 78 for receiving the locking tab 68 without requiring the operator to precisely position the adjacent side and end walls.

The locking means 64 can include a plurality of tabs 68 disposed at predetermined spaced intervals along the side wall flanges 66 as shown in FIG. 3. Further, each of the tabs are adapted to be received by the means 80 disposed on the end wall flanges 78 in a snug fashion, thereby locking the walls 16, 18, 20, 22 from relative movement with respect to each other. In the preferred embodiment of the subject invention, the locking tabs 68 substantially define a delta-shaped tab. The means 80 disposed on the end wall flanges 78 for receiving the delta-shaped locking tabs 68 include flanges 83 extending substantially along the length of the end wall flanges 78 and inwardly toward the interior 24 defined by the container 10. The inwardly extending flanges present delta-shaped openings 84 disposed at predetermined positions along the end wall flanges 78 corresponding to the delta-shaped locking tabs 68 for receiving the delta-shaped tabs. The delta-shaped openings 84 in the inwardly extending flanges 83 include first and second stop surfaces 86, 88 for engagement with the first and second locking surfaces 72, 74 on the delta-shaped tabs 68 to prevent relative movement between the side and end walls 16, 18, 20, 22.

The collapsible container assembly 10 of the subject invention further includes wall latching means generally indicated at 90 for releasably latching the adjacent side and end walls 16, 18, 20, 22 together when the side and end walls are in the upright position as shown in FIGS. 9 and 10.

The wall latching means 90 includes a latch member 92 which is operatively mounted to the edge of the side walls 16, 18 by a fastening means such as a rivit 94 or the like and is movable between latched and unlatched positions. The wall latching means further includes means, generally indicated at 96, disposed on the interior 24 of the container 10 for moving the latch member to the unlatched position. More specifically, the means 96 is disposed on the interior planar sheet 56 of the side walls 16, 18 and includes an opening 98 disposed on the interior planar sheet 56 of the side walls 16, 18. The means 96 further includes an interior latch actuator 100 disposed within the opening 98 and operatively connected to the latch member 92 and adapted to move the latch member 92 to the unlatched position. The wall latching means 90 also includes an exterior latch actuator 102 which is also operatively connected to the latch member 92 but which is disposed on the side walls 16, 18 on the outside of the container. Preferably, the container 10 includes wall latching means 90 disposed at either side of the side walls 16, 18 for releasably latching each of the side walls 16, 18 to each of the adjacent end walls 20, 22 when the side and end walls are in the upright position. In this way, the latch member 92 may be moved to the unlatched position from either the interior 24 or the exterior of the container. Thus, when two or more containers are closely juxtaposed with respect to each other such that it is difficult to release the latch member 92 to collapse the container from the exterior of the container, an operator may easily reach into the interior of the container and move the interior latch actuator 100 so as to move the latch member 92 to the unlatched position.

The latch member 92 further includes a projection 104 extending outwardly from the side of the side walls 16, 18 and a groove 106 disposed in the adjacent end walls 20, 22 opposite the projection 104. The projection 104 includes a chamfer 108 disposed on the distal end of the projection 104. The projection 104 is slideably disposed in the groove 106 when the adjacent side and end walls 16, 18, 20, 21 are in the upright and locked position. The wall latching means 90 further includes a biasing means 110 for urging the projections 104 of the latch member 92 into engagement with groove 106 when the adjacent side and end walls are in the upright position. The basing means 110 and the chamfer 108 on the projections 104 allow the side walls 16, 18 to be moved from a collapsed position and snapped into an upright position and latched with the end walls 20, 22 without manual manipulation of the latch members 92.

More specifically, the biasing means is a spring 110 and is disposed between a portion of the wall latching means 90 fixedly connected to the side wall 16, 18 and latch member 92 and exerts a force on the latch member 92 to urge the projection 104 outward. The chamfer 108 is disposed on the distal end of the projection 104 on its outward side furthest from the interior 24 of the container assembly 10. The projection 104 also includes a flat side 112 which extends parallel to the side wall of the groove 106. Both the camfer 108 and the flat side 112 are disposed at the distal end of the projection 104 and opposite one another. When the walls 16, 18, 20, 22 are in the vertical upright closed and locked position, the container may be collapsed only by manually disengaging the latch member 92. This may occur by pulling either the interior or exterior actuators 100, 102 to place the spring 110 in compression until the projection 104 has been retracted out of the groove 106. The walls 16, 18, 20, 22 may than be rotatably moved to their collapsed position. However, moving the side and end walls 16, 18, 20, 22 from their collapsed to their upright position requires only that the container walls must be erected with such sufficient force to drive the projection 104 into retraction when the chamfer 108 of the projection 104 comes into contact with the end wall flanges 78. Said another way, the wall latching means 90 includes a snap-in feature attendant upon moving the end and side walls 16, 18, 20, 22 from the collapsed to the upright and erect position. The chamfer 108 facilitates the automatic retraction of the projection 104 upon erecting the container 10 without manual manipulation of the latch member 92. After the projection 104 has been retracted and the walls placed in the fully upright position, the projection 104 is urged into the groove 106 by the spring 110.

As shown in FIGS. 1 and 2, at least one of the side walls 16, 18 include an opening 114 therein and also includes a door 116 disposed in the opening 114 of the side walls 16, 18 for opening an closing the opening 14 to allow access to the interior 24 of the container 10 through the side walls 16, 18 when the side walls 16, 18 are in the vertical position. The door 116 includes at least one locking tab 118 disposed along the periphery thereof and extending outwardly from the door 116. Means generally indicated at 120, is disposed on the opening 114 in the side wall 16, 18 for receiving the locking tab 118 in a snug fashion and thereby locking the door 116 from relative movement with respect to the opening 114 in the side walls 16, 18. Further the door 116 may include a plurality of tabs 118 disposed at predetermined spaced intervals along the door 116. Each of the tabs 118 is adapted to be received by the means 120 disposed on the opening 114 of the side wall 116 in a snug fashion. More specifically, the locking tabs 118 substantially define delta-shaped tabs. Further, the means 120 for receiving the delta-shaped tabs are substantially delta-shaped interruptions 122 disposed at predetermined positions along the opening 114 of the side walls 116, 118. Similarly with the locking tabs 68 of the wall locking means 64, the delta-shaped tabs 118 include first and second locking surfaces 124, 126. The delta-shaped interruptions 122 include first and second stop surfaces 128, 130 for engagement with the first and second locking surfaces 124, 126 on the delta-shaped tabs 118 to prevent relative movement between the door 116 and the opening 114 in the side walls 16, 18 when the door 116 is in the closed position. Preferably, the delta-shaped tabs 118 and the delta-shaped interruptions 122 are disposed on either side of the door 116 and the opening 114.

The door 116 also includes a door hinge means 117 disposed at the bottom edge of the door 116 adjacent the side walls 16, 18 for allowing pivotal movement of the door 116 relative to the side walls 16, 18. The door hinge means 117 includes a tongue and groove arrangement similar to the wall hinge means 26 as described above.

Figure 11:
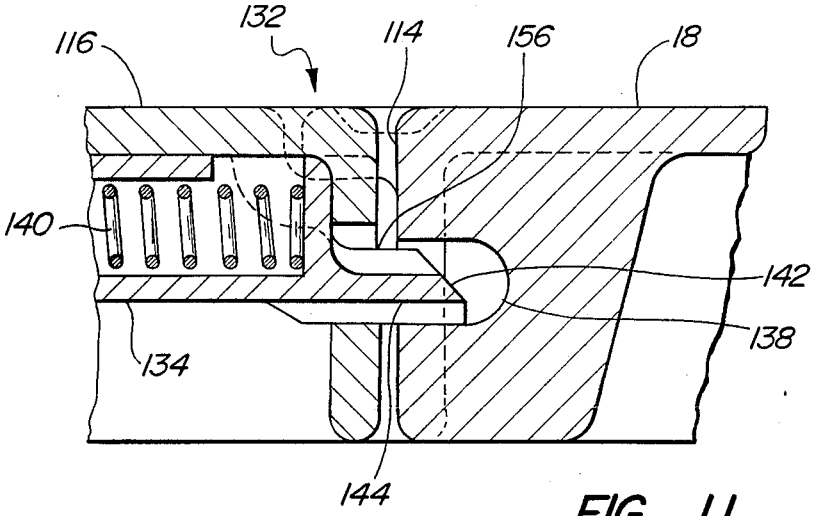
FIG. 11 is an enlarged top view of the door latching means with the door latched in the vertical closed position.

The assembly 10 also includes a door latching means, generally indicated at 132, for releasably engaging the door 116 with the side walls 16, 18 in a latched condition to prevent pivotal movement of the door 116 relative to the side walls 16, 18 and releasably disengaging the door 116 from the side walls 16, 18 in an unlatched condition to allow pivotal movement of the door 116 relative to the side walls 16, 18. The door latching means 132, as shown in FIG. 11, is similar to the wall latching means 90 as shown in FIG. 9. The door latching means 132 includes a latch member 134 mounted on the door 116 and having projections 136 extending outwardly from one side thereof and slideably disposed in a groove 138 in the opening 114. The projections 136 are biased outwardly from the door 116 and into engagement with the groove 138 by a biasing means 140 such as a spring. The spring 140 is disposed between the door 116 and the latch member 134 and exerts a force on the latch member 134 to urge the projection 136 outward. The projections 136 include a chamfer 142 on its inward side nearest to the inside of the container assembly 10 and a flat side 144 which extends parallel to the side wall of the groove 138. The door latching means 132 operates in the same manner as the wall latching means 90 and includes the snap-in feature such that the door may be moved from the open position to the closed position without manual manipulation of the door latching means 132. However, the door may not be opened unless the latch members 134 are retracted to place the spring 140 in further compression until the projections 136 have been retracted out of the groove 138. Further, when the door 116 is in the fully opened position, the door 116 partially blocks the channels 44 and thereby prevents the container assembly from being moved by a fork lift or the like when the door 116 is in the open position.

Figure 12:
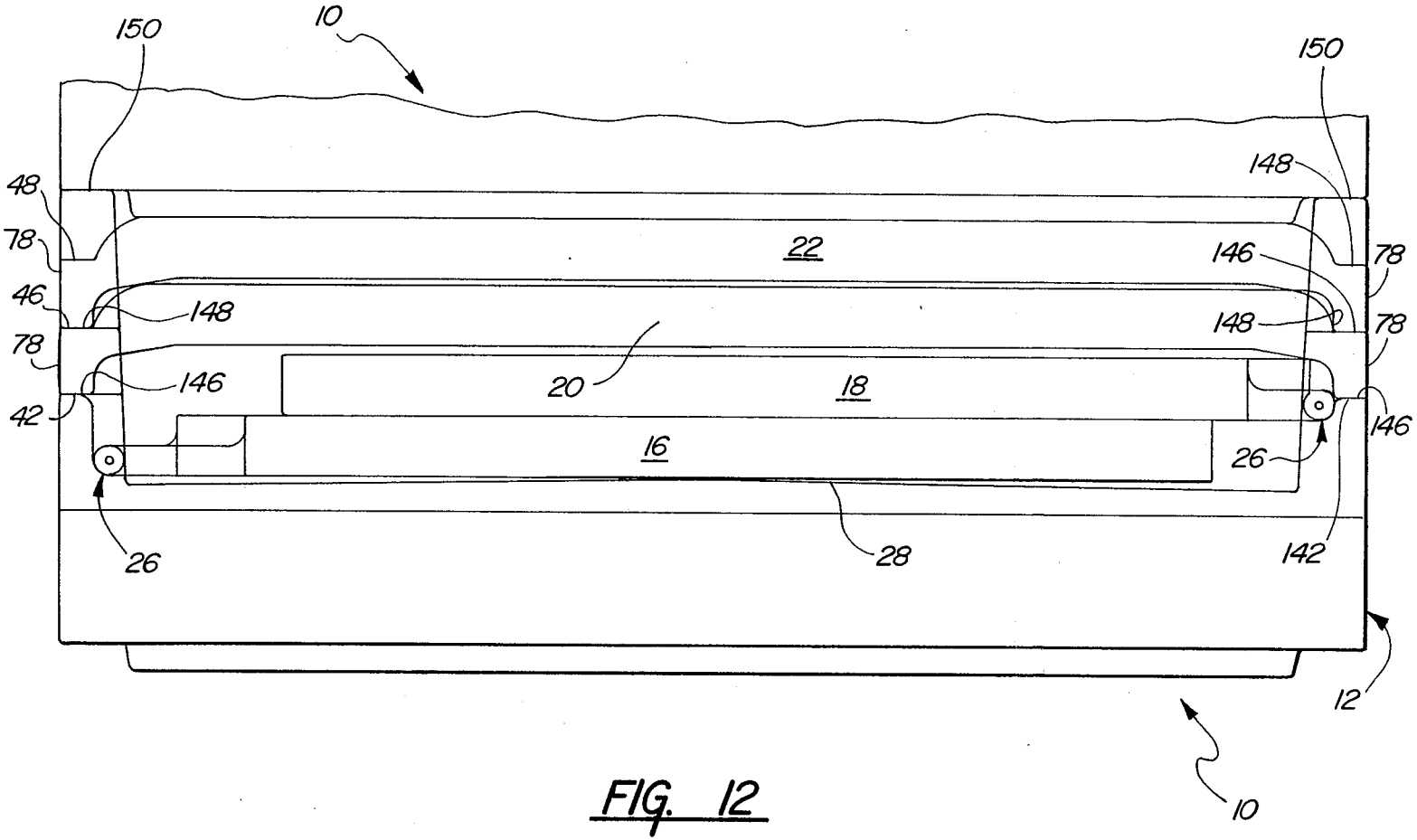
FIG. 12 is a side view of the container when the walls are in the collapsed position.
Figure 13:
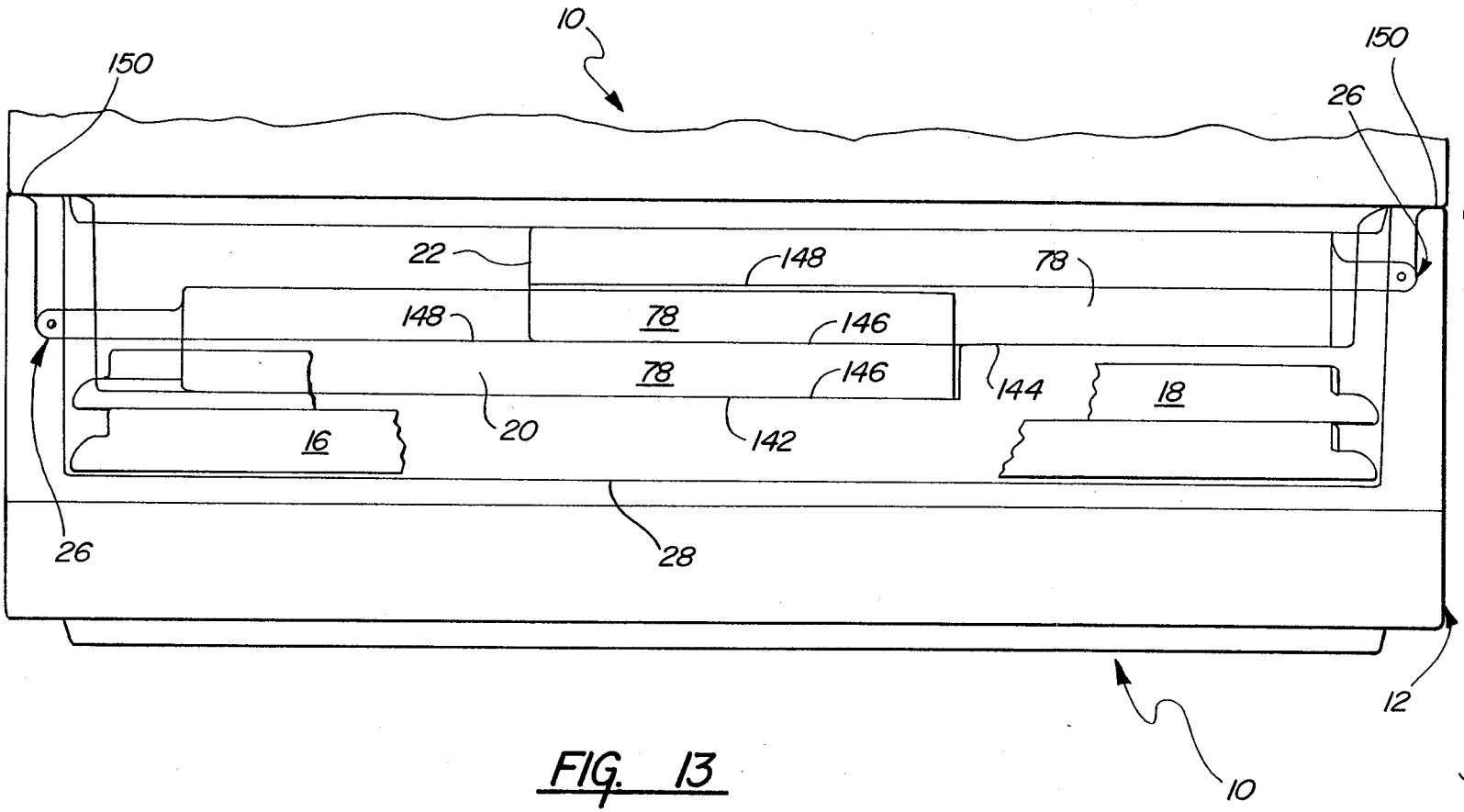
FIG. 13 is a side view of the container when the walls are in the collapsed position.
Figure 14:
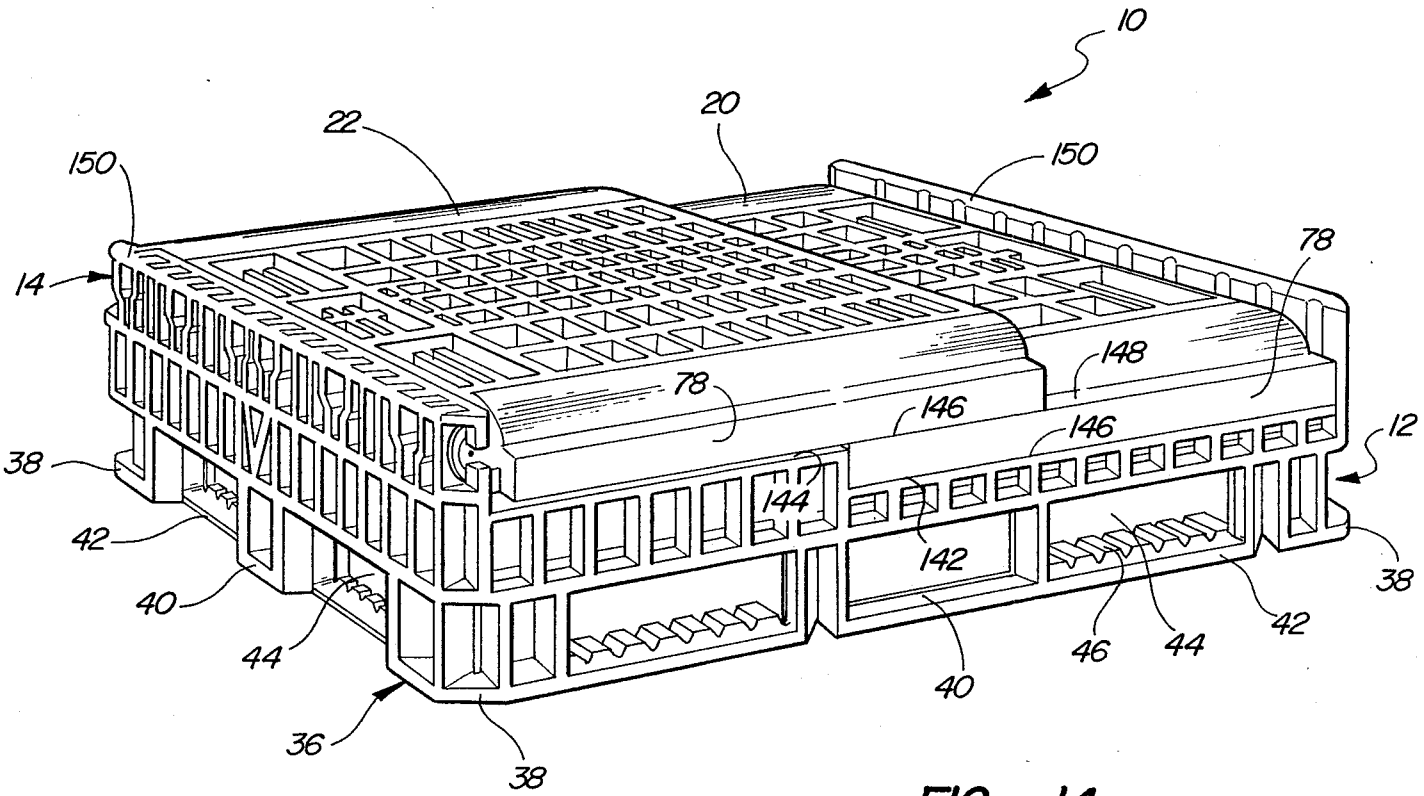
FIG. 14 is a perspective view of the container when the walls are in the collapse position.

Referring now to FIGS. 12, 13 and 14, there is shown generally at 10 a container in the collapsed condition. The hinge means 26 for a first side wall 16 is disposed in a vertically spaced horizontal plane from the hinge means 26 of a second side wall 18 for folding the first and second side walls 16, 18 over the base 12 and into overlapping vertically spaced relationship with respect to one another as shown in FIG. 12. The base sides 14 for the first and second side walls 16, 18 include a first portion 142 and a stepped portion 144 defining a surface disposed in a vertically spaced horizontal plane from the first portion 142 on the bases side 14 for the first and second side walls 16, 18 as shown in FIGS. 13 & 14. The end wall flanges 78 on the end walls 20, 22 include stacking surfaces 146 disposed on the terminal end of the perpendicular extending end wall flanges 78 adjacent to the flanges 82 and along a substantial portion of the length of the flanges 78. The flanges 78 also include a back surface 148 disposed in parallel spaced relation with respect to the stacking surface 146.

The hinge means 26 for the first end wall 20 is in a vertically spaced horizontal plane from the hinge means 26 for a second end wall 22 for folding the first and second end walls 20, 22 over the first and second side walls 16, 18 and into overlapping vertical spaced relationship with respect to one another. When in the collapsed position, the stacking surfaces 146 on the first end wall flanges 78 are disposed on the first portions 142 of the base sides 14 for the first and second side walls 16, 18 and are supported thereby. Said in another way, the first portion 142 of the base sides 14 of the first and second side walls 16, 18 are specifically adapted to support the stacking surfaces 142 of the first end wall flanges 78 when the first end wall 20 is in a collapsed position.

The stacking surfaces 146 of the second end wall flanges 78 are disposed on the stepped portion 144 of the base sides 14 for the first and second side walls 16, 18 for a first predetermined distance along the length of the stepped portion 144 and disposed on t he back surface 148 of the end wall flanges 78 on the first end wall 20 for a second predetermined distance and is supported thereby. Said another way, the stepped portion 144 of the base side 14 of the first and second side walls 16, 18 are specifically adapted to support the stacking surface 146 of the second end wall flange 78 for a first predetermined distance along the length of the stepped portion 144. In addition, the back surface 148 of the end wall flange 78 on the first end wall 20 is specifically adapted to support the stacking surface 146 on the second end wall flange 78 for the remainder of the stacking surface not resting on the back surface 148 when the second end wall 22 is in a collapsed position.

When the container 10 is in the collapsed position, the base sides 14 for the first and second end walls 20, 22 present support surfaces 150 upon which another container 10 may rest when in the stacked position. Further, the second end wall 22 also helps to directly support another stacked container 10. This load is then transferred from the side and end walls 16, 18, 20, 22 to the base 12 in an efficient manner such that large loads may be supported.

In this way, the container may be efficiently moved to its collapsed position and may also be stacked one upon the other without fear of any of the containers failing.

The invention has been described in an illustrative manner, and it is to be understood that the terminology which has been used is intended to be in the nature of words of description rather than of limitation.

Obviously, many modifications and variations of the present invention in light of the above teachings. It is, therefore, to be understood that within the scope of the appended claims wherein reference numerals are merely for convenience and are not to be in any way limiting, the invention may be practiced otherwise than as specifically described.

What is claimed is:

1. A collapsible container assembly (10) comprising;

a base (12) having a plurality of sides (14);

a pair of side walls (16,18) and a pair of end walls (20,22), each wall adapted to be extended vertically upward from a side (14) of said base (12) to define an interior portion (24) of said container (10) and including wall hinge means (26) interconnecting each of said side and end walls (16,18,20,22) to said base (12) and moveably supporting said walls as said walls are moved between a collapsed position to an upright position;

locking means (64) on adjacent side and end walls (16,18,20,22) for providing interlocking engagement therebetween when said walls are in said upright position;

said locking means (64) including a flange (66) disposed on said side wall (16,18) along a substantial portion of the length thereof, said flange (66) including at least one locking tab (68) extending away from said interior (24) of said container (10), said locking tab (68) including an outermost surface (70) disposed furtherest from said interior (24) of said container (10) and first and second locking surfaces (72,74) extending between said outermost surface (70) and said side wall flange (66) and further including a contact surface (76) extending between said outermost surface (70) and said side wall flange (66) and between said first and second locking surfaces (72,74) and forming an obtuse angle with respect to said outermost surface (70);

said locking means (64) further including a flange (78) disposed on said end wall (20,22) along a substantial portion of the length thereof and extending perpendicular to said end wall (20,22) and means (80) disposed on said end wall flange (78) for receiving said at least one locking tab (68) in a snug fashion and thereby locking said walls (16,18,20,22) from said relative movement with, respect to each other;

said end wall (20,22) including a guide surface (82) disposed on said end wall (20,22) directly adjacent said end wall (20,22) flange (66), said contact surface (76) on said at least one locking tab (68) adapted for sliding frictional engagement with said guide surface (82) on said end wall (20,22) as said side wall (16,18) is moved from said collapsed position to said upright position to guide said tab (68) into locking engagement with said means (80) for receiving said locking tab (68) and for preventing relative movement of said walls with respect to each other when in said upright position.

2. An assembly as set forth in claim 1 further characterized by said guide surface (82) forming an obtuse angle with said end wall (20,22) flange (78) to facilitate said sliding frictional engagement between said contact surface (76) on said locking tab (68) and said guide surface (82) as said side wall (16,18) is moved from said collapsed position to said upright position to guide said tab (68) into locking engagement with said means (80) for receiving said locking tab (68) and for preventing relative movement of said walls (16,18,20,22) with respect to each other when in said upright position.

3. An assembly as set forth in claim 2 further characterized by said at least one tab including a plurality of tabs (68) disposed at predetermined spaced intervals along said side wall flange (66);

each of said tabs (68) adapted to be received by said means (80) disposed on said end wall flange (78) in a snug fashion thereby locking said walls (16,18,20,22) from relative movement with respect to each other.

4. An assembly as set forth in claim 3 further characterized by said locking tabs (68) substantially defining a delta-shaped tab, said means (80) disposed on said end wall flange for receiving said delta-shaped locking tabs (68) including flanges (83) extending substantially along the length of said end wall flange (78) and inwardly toward the interior (24) defined by the container (10);

said inwardly extending flanges (83) presenting delta-shaped openings (84) disposed at predetermined positions along said end wall flanges (78) corresponding to said delta-shaped locking tabs (68) for receiving said tabs (68).

5. An assembly as set forth in claim 4 further characterized by said delta-shaped openings (84) in said inwardly extending flanges (83) including first and second stop surfaces (86,88) for engagement with said first and second locking surfaces (72,74) on said delta-shaped tabs (68) to prevent relative movement between said side and end walls (16,18,20,22).

6. A collapsible container assembly (10) comprising;

a base (12) having a plurality of sides (14);

a pair of side walls (16, 18) and a pair of end walls (20, 22), each of said walls adapted to be extended vertically upward from a side (14) of said base (12) to define an interior portion (24) of said container (10) and including wall hinge means (26) interconnecting each of said side and end walls (16, 18, 20 22) to said base (12);

at least one of said side walls (16, 18) including an opening (114) therein, and including a door (116) disposed in said opening (114) of said side wall (16, 18) for opening and closing said opening (114) to allow access to the inside 24) of the container assembly (10) through said side wall when said side wall (16, 18) is in the vertical position, said door (116) including at least one locking tab (118) disposed along the periphery thereof and extending outwardly from said door (116);

means (120) disposed on said opening (114) in said side wall (16, 18) for receiving said locking tabs (118) in a snug fashion and thereby locking said door (116) from relative movement with respect to said opening (114) in said side wall (16, 18);

said assembly characterized by said at least one locking tab substantially defining at least one delta-shaped tab (118);

said means (120) disposed in said opening (114) in said side wall (16, 18) for receiving said delta-shaped tab (118) being at least one substantially delta-shaped interruption (122) disposed at a predetermined position along said opening (114) of said side wall (16, 18).

7. An assembly as set forth in claim 6 further characterized by said at least one tab (118) including a plurality of tabs (118) disposed at predetermined spaced intervals along said door (116);

each of said tabs (118) adapted to be received by said corresponding substantially delta-shaped interruptions (122) disposed at predetermined positions along said opening (114) of said side wall (16, 18) in a snug fashion thereby locking said door (116) from relative movement with respect to said opening (114) when said door (116) is in the closed position.

8. An assembly as set forth in claim 7 further characterized by said delta-shaped tab (118) including first and second locking surfaces (124,126) and said delta-shaped interruptions (122) on said opening (114) including first and second stop surfaces (128,130) for engagement with said first and second locking surfaces (124,126) on said delta-shaped tabs (118) to prevent relative movement between said door (116) and said opening (114) in said side walls (16,18) when said door (116) is in the closed position.

9. A collapsible container assembly (10) comprising;

a base (12) having a plurality of sides (14);

a pair of side walls (16, 18) and a pair of end walls (20, 22), each wall adapted to be extended vertically upward from a side (14) of said base (12) to define an interior portion (24) of said container (10) and including wall hinge means (26) interconnecting each of said side and end walls (16, 18, 20, 22) to said base (12) and movably supporting said walls (16, 18, 20, 22) as said walls are moved between a collapsed position to an upright position;

wall latching means (90) for releasably latching adjacent side and end walls (16, 18, 20,22) together when said side and end walls (16, 18, 20, 22) are in the upright position;

said wall latching means (90) including a latch member (92) moveable between latched and unlatched positions;

said assembly characterized by said wall latching means (90) including an exterior latch actuator (102) disposed on the exterior of said container (10) and means (96) disposed on the interior (24) of said container (10), said means (96) including an interior latch actuator (100) disposed on the interior (24) of said container (10), said interior latch actuator (100) and said exterior latch actuator (102) operatively connected to said latch member (92) for moving said latch member (92) to said unlatched position.

10. An assembly as set forth in claim 9 further characterized by said wall latching means (90) disposed on said side wall (16, 18), said means (96) disposed on the interior (24) of said container including an opening (98) disposed on said side walls (16, 18);

said interior latch actuator (100) disposed within said opening (98) and operatively connected to said latch member (92) and adapted to move said latch member (92) to said unlatched position.

11. An assembly as set forth in claim 10 further characterized by said wall latching means (90) disposed at either side of said side walls (16,18) for releasably latching each of said side walls (16,18) to each of said adjacent end walls (20,22) when said side and end walls (16,18,20,22) are in the upright position.

12. An assembly as set forth in claim 11 further characterized by said latch member (92) having a projection (104) extending outwardly from the side of said side wall (16,18) and a groove (106) disposed in said end wall (20,22) opposite said projection (104), said projection (104) including a chamfer (108) disposed on the distal end of said projection (104), said projection (104) being slideably disposed in said groove (106) when said adjacent side and end walls (16,18,20,22) are in the upright position.

13. An assembly as set forth in claim 12 further characterized by said wall latching means (90) including a biasing means (110) for urging said projections (104) of said latch member (92) into engagement with said groove (106) when said adjacent side and end walls (16,18,20,22) are in the upright position, said biasing means (110) and chamfer (108) on said projections (104) allowing said side wall (16,18) to be moved from said collapsed position and snapped into said upright position without manual manipulation of said latch members (92).

14. A collapsible container assembly (10) comprising;

a base (12) having a plurality of sides (14);

a pair of side walls (16,18) and a pair of end walls (20,22), each wall adapted to be extended vertically upward from a side (14) of said base (12) to define an interior portion (24) of said container (10) and including wall hinge means (26) interconnecting each of said side and end walls (16,18,20,22) to said base (12) and movably supporting said walls (16,18,20,22) as said walls are moved between a collapsed position and an upright position;

said hinge means (26) for a first side wall (16) being in a vertically spaced horizontal plane from the hinge means (26) of a second side wall (18) for folding said first and second side walls (16,18) over said base (12) and onto overlapping vertically spaced relationship with respect to one another, said base sides (14) for said first and second side walls (16,18) including a first portion (142) and a stepped portion (144) defining a surface disposed in a vertically spaced horizontal plane from said first portion (142) on said base side (14) for said first and second side walls (16,18);

said end walls (20,22) including flanges (78) disposed at the sides of said end walls (20,22) and along a substantial portion of the length thereof and extending perpendicular to said end walls (20,22);

said end wall flanges (78) including a stacking surface (146) disposed on the terminal end of said perpendicular extending end wall flange (78) and along a substantial portion of the length thereof and a back surface (148) disposed in parallel spaced relation from said stacking surfaces (146);

said hinge means (26) for a first end Wall (20) being in a vertically spaced horizontal plane from the hinge means (26) for a second end wall (22) for folding said first and second end walls (20,22), over said first and second side walls (16,18) and onto overlapping vertical spaced relationship with respect to one another;

said stacking surface (146) on said first end wall flange (20) disposed on said first portion (142) of said base sides (14) for said first and second side walls (16,18) and supported thereby;

said stacking surface (146) of said second end wall flange (22) disposed on said stepped portion (144) of said base sides (14) for said first and second side walls (16,18) for a first predetermined distance along the length of said stepped portion (144) and disposed on said back surface (148) of said end wall flange (78) on said first end wall (20) for a second predetermined distance and supported thereby.

15. A collapsible container assembly (10) comprising;

a base (12) having a plurality of sides (14);

a pair of side walls (16, 18) and a pair of end walls (20, 22) each of said walls adapted to be extended vertically upward from a side (14) of said base (12) to define an interior portion (24) of said container (10);

said base (12) including a rigid portion (28) forming the bottom of said container (10), said assembly characterized by said rigid portion (28) including a plurality of longitudinal support members (30) disposed parallel and perpendicular with respect to each other to form a grid, said support members (30) being made of structural foam and a metal member (34) disposed in at least one of said structural foam support members (32) for a predetermined length of said support member (32) to reinforce said support member (32).

16. A collapsible container assembly (10) comprising;

a base (12) having a plurality of sides (14);

a pair of side walls (16,18) and a pair of end walls (20,22), each of said walls adapted to be extended vertically upward from a side (14) of said base (12) to define an interior portion (24) of said container (10) and including wall hinge means (26) interconnecting each of said side and end walls (16,18,20,22) to said base (12) and moveably supporting said walls as said walls are moved between a collapsed position to an upright position;

said base (12) including a rigid portion (28) forming the bottom of said container (10), said rigid portion (28) being made of one material and reinforced with another material for strengthening said base (12) of said container (10);

a plurality of container support means (36) depending from said rigid portion (28) about the periphery thereof and straps (42) extending between said container support means (36), said straps (42) defining channels (44) between predetermined container support means (36) and including irregular shaped surfaces (46) bordering the periphery of said channels (44);

said hinge means (26) for a first side wall (16) being in a vertically spaced horizontal plane from the hinge means (26) of a second side wall (18) for folding said first and second side walls (16,18) over said base (12) and into overlapping vertically spaced relation with respect to one another;

said base side (14) for said first and second side walls (16,18) including a first portion (142) and a stepped portion (144) defining a surface disposed in a vertically spaced horizontal plane from said first portion (142) on said base side (14) for said first and second side walls (16,18);

said end walls (20,22) including flanges (78) disposed at the sides of said end walls (20,22) and along a substantial portion of the length thereof and extending perpendicular to said end walls (20,22);

said end wall flanges (78) including a stacking surfaces (146) disposed on terminal end of said perpendicular extending end wall flange (78) and along a substantial portion of the length thereof and a back surface (148) disposed in parallel spaced relation from said stacking surfaces (146);

said hinge means (26) for a first end wall (20) being in a vertically spaced horizontal plain from said hinge means (26) for a second end wall (22) for folding said first and second end walls (20,22) over said first and second side walls (16,18) and into overlapping vertical spaced relation with respect to one another;

said stacking surface (146) on said first end wall flange (78) is disposed on said first portion (142) of said base (114) sides for said first and second side walls (16,18) and supported thereby;

said stacking surface (146) of said second end wall flange (78) is disposed on said stepped portion (144) of said base sides (914) for said first and second side walls (16,18) for a first predetermined distance along the length of said stepped portion (114) and is disposed on said back surface (148) of said end wall flange (78) on said first end wall (20) for a second predetermined distance and supported thereby;

wall latching means (90) for releasably latching adjacent side and end walls (16,18,20,22) together when said side and end walls (16,18,20,22) are in the upright position;

said wall latching means (90) including a latch member (92) moveable between latched and unlatched positions;

said wall latching means (90) including means (96) disposed on the interior (24) of said container (10) for moving said latch member (92) to said unlatched position:

locking means (64) on said adjacent side and end walls (16,18,20,22) for providing interlocking engagement therebetween when said walls are in said upright position;

said locking means (64) including a flange (66) disposed on said side wall (16,18) along a substantial portion of the length thereof, said flange (66) including at least one locking tab (68) extending away from said interior (24) of said container (10);

said locking tab (68) including an outermost surface (70) disposed furthest from said interior (24) of said container and first and second locking surfaces (72,74) extending between said outermost surface (70) and said side wall flange (66) and further including a contact surface (76) extending between said outermost surface (70) and said side wall flange (66) and between said first and second locking surfaces (72,74) and forming an obtuse angle with respect to said outermost surface (70);

and means (80) disposed on said end wall flange (78) for receiving said at least one locking tab (68) in a snug fashion and thereby locking said walls (16,18,20,22) from said relative movement with respect to each other;

said end wall (20,22) including a guide surface (82) disposed on said end wall (20,22) directly adjacent said end wall flange (78), said contact surface (76) on said at least one locking tab (68) adapted for sliding frictional engagement with said guide surface (82) on said end wall (20,22) as said side wall (16,18) is moved from said collapsed position to said upright position to guide said tab (68) into locking engagement with said means (80) for receiving said locking tab (68) and for preventing relative movement of said walls (16,18,20,22) with respect to each other when in said upright position.

* * * * *